US010920417B2

(12) United States Patent
Hulteen et al.

(10) Patent No.: US 10,920,417 B2
(45) Date of Patent: Feb. 16, 2021

(54) FIRE-RESISTANT BUILDING JOINT SYSTEM

(71) Applicant: 3M INNOVATIVE PROPERTIES COMPANY, St. Paul, MN (US)

(72) Inventors: John C. Hulteen, Afton, MN (US); George W. Frost, Afton, MN (US); Robert E. Gestner, West St. Paul, MN (US); Richard J. Haffner, New Richmond, WI (US); Ernst L. Schmidt, Hager City, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/564,776

(22) PCT Filed: Mar. 25, 2016

(86) PCT No.: PCT/US2016/024135

§ 371 (c)(1),
(2) Date: Oct. 6, 2017

(87) PCT Pub. No.: WO2016/167937

PCT Pub. Date: Oct. 20, 2016

(65) Prior Publication Data

US 2018/0106034 A1 Apr. 19, 2018

Related U.S. Application Data

(60) Provisional application No. 62/149,060, filed on Apr. 17, 2015.

(51) Int. Cl.
*E04B 1/94* (2006.01)
*E04B 2/74* (2006.01)

(52) U.S. Cl.
CPC ..... *E04B 1/948* (2013.01); *E04B 2/7411* (2013.01); *E04B 2/7448* (2013.01)

(58) Field of Classification Search
CPC ..... E04B 1/94; E04B 1/948; E04B 2/7411
See application file for complete search history.

(56) References Cited

U.S. PATENT DOCUMENTS 3,786,604 A * 1/1974 Kramer ..... E04B 1/6801 52/232
4,018,962 A 4/1977 Pedlow
4,018,983 A 4/1977 Pedlow
(Continued)

FOREIGN PATENT DOCUMENTS

CN 1749343 3/2006
DE 10223688 12/2003
(Continued)

OTHER PUBLICATIONS

ASTM E-1966-07, "Standard Test Method for Fire-Resistant Joint Systems", 2011, pp. 1-16.
(Continued)

*Primary Examiner* — Jessie T Fonseca
(74) *Attorney, Agent, or Firm* — Julie Lapos-Kuchar

(57) ABSTRACT

Described herein is a fire-rated system construction for building joint systems and method thereof, wherein a packing material and a non-porous adhesive article are used to pack and seal a building joint.

20 Claims, 1 Drawing Sheet

(56) References Cited

U.S. PATENT DOCUMENTS

| | | | | |
|---|---|---|---|---|
| 4,063,395 | A * | 12/1977 | Stewart | E04B 7/00 52/309.5 |
| 4,329,384 | A | 5/1982 | Vesley | |
| 4,330,590 | A | 5/1982 | Vesley | |
| 5,187,910 | A * | 2/1993 | Nicholas | E04B 1/948 52/317 |
| 5,374,477 | A | 12/1994 | Lawless et al. | |
| 5,765,332 | A * | 6/1998 | Landin | E04B 1/948 52/235 |
| 5,974,750 | A | 11/1999 | Landin | |
| 6,410,137 | B1 | 6/2002 | Bunyan | |
| 6,441,092 | B1 * | 8/2002 | Gieselman | A61L 15/58 525/191 |
| 7,070,653 | B2 | 7/2006 | Frost | |
| 7,240,905 | B1 | 7/2007 | Stahl, Sr. | |
| 7,856,775 | B2 * | 12/2010 | Stahl, Jr. | E04B 2/88 52/1 |
| 8,097,310 | B2 | 1/2012 | Miller et al. | |
| 8,178,177 | B2 | 5/2012 | Frost | |
| 8,341,908 | B1 * | 1/2013 | Hensley | E04B 1/6804 404/68 |
| 8,365,495 | B1 * | 2/2013 | Witherspoon | E04B 1/948 404/68 |
| 8,444,790 | B2 | 5/2013 | Tong | |
| 8,590,272 | B2 | 11/2013 | Thomas | |
| 8,683,763 | B2 * | 4/2014 | Shriver | E04B 2/96 52/235 |
| 8,813,450 | B1 * | 8/2014 | Hensley | E04B 1/6804 52/317 |
| 9,206,596 | B1 * | 12/2015 | Robinson | E04B 1/948 |
| 9,404,581 | B1 * | 8/2016 | Robinson | F16J 15/104 |
| 9,637,915 | B1 * | 5/2017 | Hensley | E04B 1/948 |
| 9,644,368 | B1 * | 5/2017 | Witherspoon | E04B 1/948 |
| 9,869,086 | B2 * | 1/2018 | Andresen | E04B 1/68 |
| 2002/0081924 | A1 | 6/2002 | Fensel | |
| 2002/0179265 | A1 * | 12/2002 | Snyder | B32B 17/02 162/137 |
| 2002/0182964 | A1 * | 12/2002 | Snyder | B32B 17/02 442/394 |
| 2004/0137185 | A1 | 7/2004 | Sieber et al. | |
| 2004/0137813 | A1 | 7/2004 | Faucher | |
| 2004/0219853 | A1 | 11/2004 | Weir et al. | |
| 2005/0034389 | A1 | 2/2005 | Boot | |
| 2007/0014960 | A1 | 1/2007 | Emanuel | |
| 2011/0113709 | A1 | 5/2011 | Pilz | |
| 2013/0318911 | A1 | 12/2013 | Sealock | |
| 2014/0008086 | A1 | 1/2014 | Foerg | |
| 2018/0002868 | A1 * | 1/2018 | Robinson | E04B 1/6812 |

FOREIGN PATENT DOCUMENTS

| | | |
|---|---|---|
| EP | 2930281 | 10/2015 |
| GB | 2472402 | 2/2011 |
| GB | 2522934 | 8/2015 |
| JP | 07042271 | 2/1995 |
| JP | 07042271 A * | 2/1995 |
| WO | WO 94/20055 | 9/1994 |
| WO | WO 1996-26332 | 8/1996 |
| WO | WO 2003/038206 | 5/2003 |
| WO | WO 2015-155201 | 10/2015 |
| WO | WO 2016/167938 | 10/2016 |
| WO | WO 2016/167956 | 10/2016 |
| WO | WO 2016/168169 | 10/2016 |

OTHER PUBLICATIONS

UL 2079, "Standard for Safety, Tests for Fire Resistance of Building Joint Systems", Fourth Edition, 2004, pp. 1-24 and A1-C2.

International Search Report for PCT International Application No. PCT/US2016/024135, dated Jun. 8, 2016, 4 pages.

ASTM E1399/E1399M-97, "Standard Test Method for Cyclic Movement and Measuring the Minimum and Maximum Joint Widths of Architectural Joint Systems," downloaded Apr. 5, 2019, 6 pages.

* cited by examiner

FIRE-RESISTANT BUILDING JOINT SYSTEM

CROSS REFERENCE TO RELATED APPLICATIONS

This application is a national stage filing under 35 U.S.C. 371 of PCT/US2016/024135, filed Mar. 25, 2016, which claims the benefit of U.S. application Ser. No. 62/149,060, filed Apr. 17, 2015, the disclosure of which is incorporated by reference in its/their entirety herein.

TECHNICAL FIELD

A fire-resistant joint system is described comprising an adhesive article and a packing material.

BACKGROUND

Openings such as joints, voids, gaps, or other discontinuities between two or more adjacent structural elements are present in buildings to accommodate building movements. Movements can occur between the adjacent structural elements, for example due to loads, heat, wind, and seismic events. These openings are sometimes referred to as dynamic joints, since they change (expand and contact or flex) over time.

Building codes for commercial structures (e.g., apartments, office buildings) generally require a passive fire protection system to contain and/or slow the spread of a fire. Fire-resistant materials such as walls and doors are used, but the openings (or joints) between the adjacent structural elements need to be treated to prevent flame and hot gases from passing through the joints into adjoining areas.

SUMMARY

There is a desire to identify alternative joint systems for treating building joints, which may allow advantages in ease of use, range of use, and/or aesthetics. These alternative joint systems must also be fire-resistant.

In one aspect, a non-porous adhesive article and packing material is used to provide a fire-resistant joint system, wherein the fire-resistant joint system comprises a first structural element having a first attachment area and a second structural element having a second attachment area, the first and second structural elements being moveable with respect to one another, the first and second attachment areas defining a space therebetween, the space having a fixed length and a width which varies from a minimum width to a maximum width as the structural elements move with respect to each other, wherein the space comprises a packing material and the non-porous adhesive article is fixedly attached to the first attachment area and the second attachment area.

In another aspect, a fire-rated system is described comprising (a) a non-porous adhesive article comprising a substrate and an adhesive disposed on a first major surface of the substrate;

(b) a packing material; and (c) a structure having a joint, the joint including a first structural element having a first attachment area and a second structural element having a second attachment area, the first and second structural elements being moveable with respect to one another, the first and second attachment areas defining a space therebetween, the space having a fixed length and a width which varies from a minimum width to a maximum width as the structural elements move with respect to each other, wherein the space comprises the packing material and wherein the adhesive is fixedly attached to the first attachment area and the second attachment area.

In yet another aspect, a method of attaching a fire barrier system to a dynamic joint in a structure is described, the dynamic joint including a first structural element having a first attachment area and a second structural element having a second attachment area, the first and second structural elements being moveable with respect to one another, the first and second attachment areas defining a space therebetween, the space having a fixed length and a width which varies from a minimum width to a maximum width as the structural elements move with respect to each other, the method for attaching comprising the step of:

(a) filling the space with a packing material; and (b) fixedly attaching a non-porous adhesive article comprising a substrate and an adhesive disposed on a first major surface of the substrate such that the adhesive contacts the first attachment area and the second attachment area to form a fire-resistant joint system.

The above summary is not intended to describe each embodiment. The details of one or more embodiments of the invention are also set forth in the description below. Other features, objects, and advantages will be apparent from the description and from the claims.

BRIEF DESCRIPTION OF THE DRAWINGS

Shown in FIG. 1 is a side-view of one side of a wall comprising an exemplary joint system of a wall-to-wall joint disclosed herein.

Shown in FIG. 2 is a side-view of a gypsum wall comprising an exemplary joint system disclosed herein.

Figure 3:
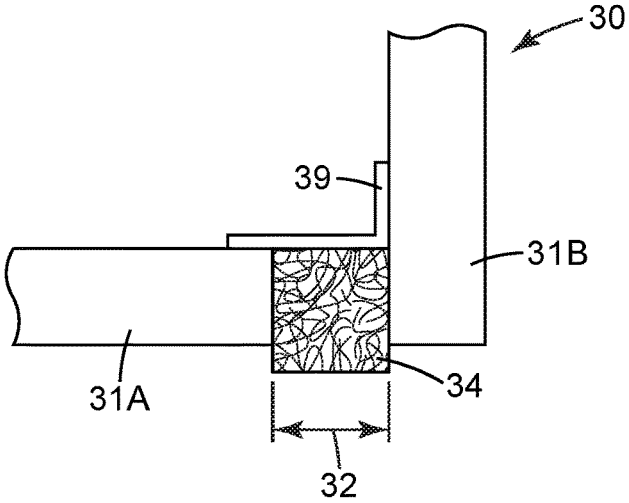

Shown in FIG. 3 is a side-view of one side of a wall comprising an exemplary joint system of a 90 degree joint disclosed herein.

Figure 4:
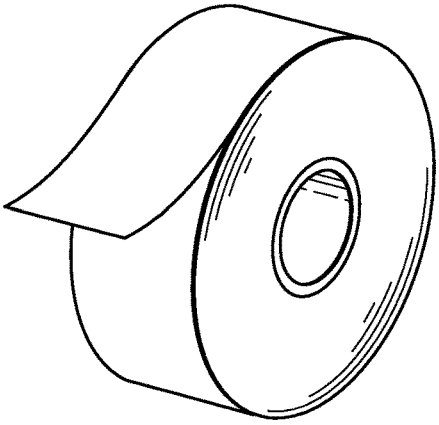

Shown in FIG. 4 is an exemplary view of an adhesive article in a roll format.

DETAILED DESCRIPTION

As used herein, the term

"a", "an", and "the" are used interchangeably and mean one or more; and

"and/or" is used to indicate one or both stated cases may occur, for example A and/or B includes, (A and B) and (A or B).

Also herein, recitation of ranges by endpoints includes all numbers subsumed within that range (e.g., 1 to 10 includes 1.4, 1.9, 2.33, 5.75, 9.98, etc.).

Also herein, recitation of "at least one" includes all numbers of one and greater (e.g., at least 2, at least 4, at least 6, at least 8, at least 10, at least 25, at least 50, at least 100, etc.).

The present disclosure is directed toward the treatment of openings between or bounded by two or more adjacent structural elements in a building (also known as a joint) to make them fire-resistant. Surprisingly, it has been discovered that by packing the opening with a packing material and sealing with a non-porous adhesive article, such as a tape, can provide a fire-resistant joint system. As used herein, fire-resistant means that the joint system can, for a period of time, withstand the heat intensity (under conditions of a fire)

and not structurally fail or allow the cold side of the joint to become hotter than a given temperature (e.g., about 200° C.).

In one embodiment, the fire-resistant joint system is a fire-rated joint system, which passes an approved regiment of testing. Such tests include: ASTM method E2307-15 "Standard Test Method for Determining Fire Resistance of Perimeter Fire Barriers Using Intermediate-Scale, Multi-story Test Apparatus"; ASTM method E1966-07 "Standard Test Method for Fire-Resistive Joint Systems"; and the UL (Underwriters Laboratory) standard 2079-2008 (R2012) "Standard for Safety Tests for Fire Resistance of Building Joint Systems". UL 2079 is similar to ASTM E1966 having a fire endurance test as well as a hose stream test, but also includes optional tests for air leakage and water leakage. Other tests includes: CAN/ULC "Standard Method of Fire Tests of Firestop Systems"; EN1366-4:2006+A1:2010 "Fire Resistance Tests for Service Installations-Linear Joint Seals"; BS 476 Part 20 (1987): "Fire Tests on Building Materials and Structures"; AS 1530.4-2005 "Methods of Fire Tests on Building Materials, Components, and Structures Part 4: Fire Resistance Test of Elements of Construction"; and ISO 10295-2:2009 "Fire Tests for Building Elements and Components—Fire Testing of Service Installations—Part 2: Linear Joint (Gap) Seals".

To pass an approved fire-resistant test, the joint systems of the present disclosure need to withstand a defined temperature profile (for example, exceeding temperatures greater than 700° C.) for a period of time (as described in the standards). In one embodiment, the joint systems of the present disclosure pass a flexibility test, wherein the joint system is expanded and contracted for a given number of cycles. In one embodiment, the joint systems of the present disclosure need to pass a hose stream test, wherein a stream of water at a given pressure and time (as described in the standards) is delivered onto the joint system after a fire endurance test. The joint system is then rated based on the outcome of the tests. For example, if there are no failures at 1 hour following the test methods, the joint system is then rated for 1-hour. In one embodiment, the fire-resistant joint system of the present disclosure withstands the approved regiment of testing for a period of at least 30 minutes, at least 1 hour, at least 2 hours, or even at least 4 hours.

As mentioned above, the UL standard 2079 also includes an optional air leakage test (ability of the system to withstand pressure differentials) and water leakage test (ability of the system to withstand intermittent water exposure, e.g., rain, standing water, spills, etc.), which can then result in an L rating and W rating, respectively.

In one embodiment, the systems of the present disclosure pass ASTM E1966-07, E2307-15, and/or UL 2079-2008. In one embodiment, the systems of the present disclosure also pass the optional air leakage test and/or the water leakage test of UL 2079-2008 (R2012).

Figure 1:
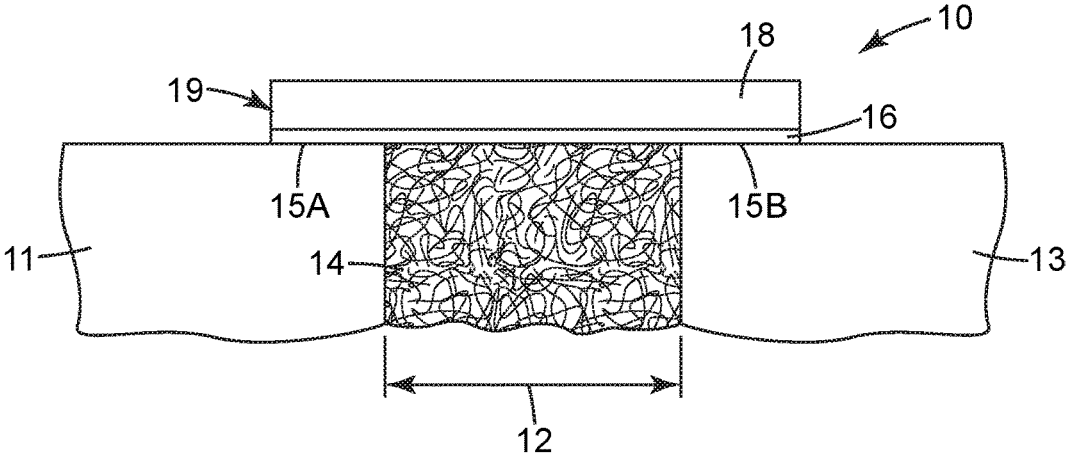

FIG. 1 depicts an exemplary configuration of a joint system of the present disclosure between two parallel elements of one side of a construction assembly (e.g., a wall). First structural element 11 and second structural element 13 have a space (i.e., opening) 12 therebetween. Space 12 is at least partially filled with packing material 14. Non-porous adhesive article 19 is applied over space 12, wherein the non-porous adhesive article is fixedly attached via adhesive 16 to first attachment area 15A and second attachment area 15B.

Shown in FIG. 1 is a opening between two parallel structural elements (e.g., wall-to-wall or floor-to-floor), however, the opening can also occur between structural elements that are approximately at a ninety degree angle with respect to one another, such as joints between floor-to-wall or head-of-wall.

Typically the structural elements are capable of moving independently of one another. Thus the size of space 12 can vary as the first structural element flexes relative to the second structural element due to thermal changes, wind, seismic activity, etc. The space between the structural elements is often referred to as a linear opening, because the length of the opening is at least 10 times greater than the width of the opening. The width of the opening may vary from its nominal joint width (i.e., the specified or installation width) ranging from a minimum joint width to a maximum joint width. The nominal width of the joint can vary depending of where the joint is located, for example, in the interior or the perimeter of the construction, with the perimeter wall generally having a larger nominal width. In one embodiment, a nominal width is at least 0.125, 0.25, 0.5, 0.75, 0.825, or even 1 inch (3.1, 6.4, 12.7, 19, 21, or even 25.4 mm); and at most 2, 3, 4, or even 5 inches (50.8, 76.2, 101.6, or even 127 mm), having a compression/expansion of at least 1%, 2%, 5%, or even 7%; and at most 20%, 25%, 30%, 40%, 50%, or even 55% of the nominal width. For example, if the nominal width is 1 inch, a compression/expansion at 25% would be 0.75 inches in compression to 1.25 inches in expansion. In one embodiment, e.g., a perimeter wall, the nominal width is at least 2, 3, or even 5 inches (50.8, 76.2, or even 127 mm); and at most 8, 9, 10, or even 11 inches (203, 229, 254, or even 279 mm), having a compression/expansion of at least 1%, 2%, 5%, or even 7%; and at most 20%, 25%, 30%, 40%, 50%, or even 55% of the nominal width.

It is an objective of the present disclosure that the joint system is fire-resistant, wherein the joint system comprises the joint assembly (e.g., first and second structural elements), the packing material, and the adhesive article. In one embodiment the joint system of the present disclosure passes a fire-rating test such that the joint system meets the desired fire-rating. It is also an objective in the present disclosure that in one embodiment, the adhesive article seals the opening and that the seal not be compromised during the shifting of the first and second structural elements relative to one another.

The joints disclosed herein occur in building constructions, thus, the non-porous adhesive article of the present disclosure is fixedly attached to structural elements made of construction materials such as gypsum wallboard (i.e., sheetrock), metal (e.g., steel, aluminum), cement (e.g., Portland cement concrete), concrete, mortar, masonry (e.g., brick and cement blocks), wood, plastics, and combinations thereof.

The packing material of the present disclosure is a high-temperature resistant material, as is known in the art (e.g., a material being thermally stable up to a temperature of at least about 150° C., 200° C., 300° C., 400° C., or even 500° C.). Exemplary high-temperature resistant material include ceramic fiber, glass fiber, mineral fiber (also known as mineral wool, basalt, or rock wool), intumescent and endothermic packing materials, and combinations thereof. These materials may be used as fabrics, mats, bats, sheets, or loose fill.

Exemplary ceramic fibrous materials include ceramic oxide fibers such as small diameter melt-blown aluminosilicate ceramic fibers commercially available, for example, under the trade designations "FIBERFRAX DURABACK BLANKET" from Carborundum Co. of Niagara Falls, N.Y., and aluminosilicate fibers commercially available, for example, under the trade designations "CERAWOOL" and "KAOWOOLII" from Thermal Ceramics of Augusta, Ga.; and ceramic oxide fibers commercially available, for example, from the 3M Co. under the trade designation "NEXTEL" (e.g., aluminosilicate ceramic oxide fibers, aluminoborosilicate ceramic oxide fibers commercially available under the trade designation "NEXTEL 312", and alumina ceramic oxide fibers commercially available under the trade designation "NEXTEL 610"). Exemplary mineral wool (such as, mineral wool derived from blast furnace slag having the major components silica, calcia, alumina, and magnesia) include those available, for example, under the trade designation "THERMOFIBER" from U.S. Gypsum of Chicago, Ill. Exemplary blends include, for example, a blend of mineral wool and glass fiber available under the trade designation "3M Fire Barrier Packing Material PM4" available from 3M Co., St. Paul, Minn.

In one embodiment the packing material is free of intumescent materials and/or from endothermic materials. In another embodiment, the packing material is constructed from intumescent materials or from endothermic materials. Intumescent materials are materials that when exposed to heat or flames, expand typically at exposure temperatures above about 200° C., and serve as a barrier to heat, smoke, and flames. Exemplary intumescent material include polymeric binders, fillers, and intumescent particles (e.g., silicates, expanding graphite, and vermiculite) such as those known in the art. Endothermic materials absorb heat and are used to shield construction components from the effects of high temperatures. Useful endothermic mat materials are available, for example, under the trade designation "INTERAM MAT E-5" from 3M Co. St. Paul, Minn. These high temperature resistant materials are generally sufficiently flexible to conform to complex shapes and to conform to dimensional changes due to movement in a dynamic joint.

The packing material of the present disclosure can have resilient properties which permit the material to be pressure fit in the joint. Typically, the packing material is installed in compression (e.g., 50% compression) to maximize fiber density and prevent loss of fit due to e.g., sagging or slipping.

In one embodiment, when filling the joint space, the packing material is added such that it is in a compressed state at the space's nominal width. The depth of packing (i.e., the distance the packing material fills beginning from the first outer surface and extending into the wall cavity) for the packing material can depend on the desired rating and the thermal resistance of the packing material as is known in the art. For example, for a wall having 1.25 inches (31.8 mm) of gypsum wallboard and a 3.5 inch (88.9 mm)-wide joint (opening), a 2 hour fire-rating is achieved when filling the wall to full depth with mineral wool, whereas the 2 hour fire-rating can be achieved by using half or less than half of the fill depth with ceramic fiber. The joint space can be packed with the packing material at its full depth (i.e., the entire length between the two walls such as in FIG. 2) for maximum fire-rating (e.g., longest time) or a fraction thereof, which may result in a lower fire-rating.

The adhesive article of the present disclosure is a multilayer article comprising a substrate and an adhesive thereon. Other layers as known in the adhesive art may be present, such as a primer layer between the substrate and the adhesive and/or a coating (e.g., ink or low-adhesive backsizing) located on the second major surface of the substrate, opposite the adhesive layer, which is located on the first major surface of the substrate.

Adhesive materials useful in the present disclosure include those that allow adhesion to a variety of construction surfaces, including, for example, concrete, metal (e.g., aluminum or steel), and gypsum wallboard. Adhesive materials suitable for the practice of the present invention include polymers of silicones, acrylics, alpha olefins, ethylene/vinyl acetate, urethanes, and natural or synthetic rubbers. In one embodiment, the adhesive is a pressure sensitive adhesive.

Suitable urethane resins include polymers made from the reaction product of a compound containing at least two isocyanate groups (—N═C═O), referred to herein as "isocyanates", and a compound containing at least two active-hydrogen containing groups. Examples of active-hydrogen containing groups include primary alcohols, secondary alcohols, phenols, and water. A wide variety of isocyanate-terminated materials and appropriate co-reactants are well known, and many are commercially available for example, polyurethane dispersion based PSA's from Dow Chemical Co. Also see, for example, Gunter Oertel, "Polyurethane Handbook", Hanser Publishers, Munich (1985)).

In one embodiment, active-hydrogen compounds containing primary and secondary amines can react with an isocyanate to form a urea linkage, thereby forming a polyurea.

Suitable acrylic resins include acrylic pressure sensitive adhesives (PSAs). Acrylic PSAs comprise polymers of one or more (meth)acrylate ester monomers, which are monomeric (meth)acrylic esters of a non-tertiary alcohol, wherein the alcohol contains from 1 to 20 carbon atoms and preferably an average of from 4 to 14 carbon atoms.

Examples of monomers suitable for use as the (meth) acrylate ester monomer include the esters derived from either acrylic acid or methacrylic acid and non-tertiary alcohols such as ethanol, 1-propanol, 2-propanol, 1-butanol, 2-butanol, 1-pentanol, 2-pentanol, 3-pentanol, 2-methyl-1-butanol, 3-methyl-1-butanol, 1-hexanol, 2-hexanol, 2-methyl-1-pentanol, 3-methyl-1-pentanol, 2-ethyl-1-butanol, 3,5,5-trimethyl-1-hexanol, 3-heptanol, 1-octanol, 2-octanol, isooctylalcohol, 2-ethyl-1-hexanol, 3,7-dimethylheptanol, 1-decanol, 1-dodecanol, 1-tridecanol, 1-tetradecanol, citronellol, dihydrocitronellol, and the like. In some embodiments, the preferred (meth)acrylate ester monomer is the ester of (meth)acrylic acid with butyl alcohol or isooctyl alcohol, or a combination thereof. In one embodiment, the (meth)acrylate ester monomer is present in an amount of 80 to 99 parts by weight based on 100 parts total monomer content used to prepare the polymer. Preferably (meth) acrylate ester monomer is present in an amount of 90 to 95 parts by weight based on 100 parts total monomer content.

The (meth)acrylic polymer further comprises a polar comonomer. For example, an acid group-containing comonomer. Examples of suitable acid-group containing monomers include, but are not limited to, those selected from ethylenically unsaturated carboxylic acids, ethylenically unsaturated sulfonic acids, ethylenically unsaturated phosphonic acids, and mixtures thereof. Examples of such compounds include those selected from acrylic acid, methacrylic acid, itaconic acid, fumaric acid, crotonic acid, citraconic acid, maleic acid, oleic acid, β-carboxyethyl (meth)acrylate, 2-sulfoethyl (meth)acrylate, styrene sulfonic acid, 2-acrylamido-2-methylpropanesulfonic acid, vinylphosphonic acid, and mixtures thereof.

Due to their availability, acid functional monomers of the acid functional copolymer are generally selected from ethylenically unsaturated carboxylic acids, i.e. (meth)acrylic acids. When even stronger acids are desired, acidic monomers include the ethylenically unsaturated sulfonic acids and ethylenically unsaturated phosphonic acids. In one embodiment, the acid functional monomer is generally used in amounts of 0 to 10 parts by weight, preferably 1 to 5 parts by weight, based on 100 parts by weight total monomer.

Other polar monomers may also be polymerized with (meth)acrylate ester monomer to form the polymer. Representative examples of other suitable polar monomers include but are not limited to 2-hydroxyethyl (meth)acrylate; N-vinylpyrrolidone; N-vinylcaprolactam; acrylamide; mono- or di-N-alkyl substituted acrylamides, such as for example t-butyl acrylamide, dimethylaminoethyl acrylamide, and N-octyl acrylamide; poly(alkoxyalkyl) (meth)acrylates including 2-(2-ethoxyethoxy)ethyl (meth)acrylate, 2-ethoxyethyl (meth)acrylate, 2-methoxyethoxyethyl (meth) acrylate, 2-methoxyethyl methacrylate, polyethylene glycol mono(meth)acrylates and mixtures thereof. Exemplary polar monomers include those selected from the group consisting of 2-hydroxyethyl (meth)acrylate and N-vinylpyrrolidone. In one embodiment, the other polar monomer may be present in amounts of 0 to 10 parts by weight, preferably 1 to 5 parts by weight, based on 100 parts by weight total monomer.

When used, vinyl monomers useful in the (meth)acrylate polymer include: alkyl vinyl ethers (e.g., vinyl methyl ether); vinyl esters (e.g., vinyl acetate and vinyl propionate), styrene, substituted styrene (e.g., α-methyl styrene), vinyl halide, and mixtures thereof. Such vinyl monomers are generally used at 0 to 5 parts by weight, preferably 1 to 5 parts by weight, based on 100 parts by weight total monomer.

In order to increase cohesive strength and improve the performance at elevated temperatures of the coated adhesive composition, a multifunctional (meth)acrylate (comprising more than more acrylate group) may be incorporated into the blend of polymerizable monomers. Multifunctional acrylates are particularly useful for emulsion or syrup polymerization. Examples of useful multifunctional (meth)acrylate include, but are not limited to, di(meth)acrylates, tri(meth) acrylates, and tetra(meth)acrylates, such as 1,6-hexanediol di(meth)acrylate, poly(ethylene glycol) di(meth)acrylates, polybutadiene di(meth)acrylate, polyurethane di(meth)acrylates, and propoxylated glycerin tri(meth)acrylate, and mixtures thereof. The amount and identity of multifunctional (meth)acrylate is tailored depending upon application of the adhesive composition. Typically, the multifunctional (meth) acrylate is present in amounts less than 5 parts based on based on 100 parts by weight total monomer. In one embodiment, the multifunctional (meth)acrylate may be present in amounts from 0.01 parts to 1 part based on 100 parts total monomers of the adhesive composition.

Optional co-monomers can be used to tailor the performance of the PSA. Optional co-monomers include those having at least two different reactive groups e.g., 2-OH (meth) acrylate and glycidyl (meth)acrylate.

In one embodiment, the (meth)acrylic polymer can be crosslinked with thermal cross-linking agents, which are activated by heat, and/or photosensitive crosslinking agents, which are activated by ultraviolet (UV) light. Useful photosensitive cross-linking agents include: multifunctional (meth)acrylates, triazines, and combinations thereof. Exemplary crosslinking agents include substituted triazines such as 2,4,-bis(trichloromethyl)-6-(4-methoxy phenyl)-s-triazine, 2,4-bis(trichloromethyl)-6-(3,4-dimethoxyphenyl)-s-triazine, and the chromophore-substituted halo-s-triazines disclosed in U.S. Pat. Nos. 4,329,384 and 4,330,590 (Vesley). Various other crosslinking agents with different molecular weights between (meth)acrylate functionality may also be useful.

In one embodiment, glycidyl (meth)acrylate may be used as a thermal crosslinking agent to provide functionality which can be activated upon or after application in the field. For example, when the adhesive article is exposed to an elevated temperature, (e.g., a fire) the epoxy group of the glycidyl (meth)acrylate may react to provide further crosslinking, which can further increase the cohesive strength and increase the temperature resistance.

Suitable silicone resins include moisture-cured silicones, condensation-cured silicones, and addition-cured silicones, such as hydroxyl-terminated silicones, silicone rubber, and fluoro-silicone. Examples of suitable commercially available silicone PSA compositions comprising silicone resin include Dow Corning's 280A, 282, 7355, 7358, 7502, 7657, Q2-7406, Q2-7566 and Q2-7735; General Electric's PSA 590, PSA 600, PSA 595, PSA 610, PSA 518 (medium phenyl content), PSA 6574 (high phenyl content), PSA 529, PSA 750-D1, PSA 825-D1, and PSA 800-C. An example of two-part silicone resin commercially available is that sold under the trade designation "SILASTIC J" from Dow Chemical Company, Midland, Mich.

Pressure sensitive adhesives (PSAs) can include natural or synthetic rubbers such as styrene block copolymers (styrene-butadiene; styrene-isoprene; styrene-ethylene/butylene block copolymers); nitrile rubbers, synthetic polyisoprene, ethylene-propylene rubber, ethylene-propylene-diene monomer rubber (EPDM), polybutadiene, polyisobutylene, butyl rubber, styrene-butadiene random copolymers, and combinations thereof.

Additional pressure sensitive adhesive include poly(alpha-olefins), polychloroprene, and silicone elastomers. In some embodiments, polychloroprene and silicone elastomers may be preferred since polychloroprene contains a halogen, which can contribute towards flame resistance, and silicone elastomers are resistant to thermal degradation.

In one embodiment, the pressure sensitive adhesives may also contain one or more conventional additives. Preferred additives include tackifiers, plasticizers, flame retardants, foaming agents, dyes, antioxidants, and UV stabilizers.

In some embodiments, a tackifying agent may be required to provide the desired adhesive characteristics. Styrene block copolymers or (meth)acrylic polymers may include a suitable tackifying resin. Suitable tackifiers include rosin acids, rosin esters, terpene phenolic resins, hydrocarbon resins, and cumarone indene resins. The type and amount of tackifier can affect properties such as tack, bond strength, heat resistance, and specific adhesion. Exemplary tackifiers include: hydrogenated hydrocarbons available under the trade brands "REGALITE" and "REGALREZ", by Eastman Chemical Co., Middelburg, Netherlands; and "ARKON" by Arakawa Chemical Inc., Chicago, Ill.; glycerin rosin ester available under the trade designation "FORAL 85" from Eastman Chemical Co., Kingsport, Tenn.; hydrocarbon or rosin types are available under the series "ESCOREZ" from ExxonMobil Chemical, Houston, Tex.; hydrocarbon resins available under the series trade designation "WINGTACK" from Cray Valley, Exton, Pa.; and terpene phenolic tackifiers available under the trade designation "SYLVARES TP96" from Arizona Chemical, Jacksonville, Fla.

In one embodiment, the PSA may contain a plasticizer, which can help soften the adhesive, and as a result, the structural element is more easily wetted by the adhesive. Further, the use of a plasticizer may improve the adhesive properties, including peel. The plasticizer may be hydrophobic and/or hydrophobic.

In one embodiment, the pressure sensitive adhesive is selected from at least one of an acrylic copolymer and a tackified styrene block copolymer.

The adhesive should have such properties that allow the adhesive article to move as the structural elements move with respect to one another. For example, in one embodiment, joints fastened with the adhesive article must pass the tests for movement in dynamic joints as described in ASTM E1399/E1399M-97 (2013) "Standard Test Method for Cyclic Movement and Measuring the Minimum and Maximum Joint Widths of Architectural Joint Systems".

In one embodiment, the adhesive has a 90° peel strength according to ASTM D6252/6252M-98 (2011) at a strain rate of 12 inches/minute of at least 0.7, 0.8, 1, 1.5, or even 2 lb/in on the structural element such as gypsum wallboard and/or concrete. However, the acceptable peel strength can be dependent upon the overlap (or attachment area) of the adhesive article to the construction material. For example, with larger adhesive overlaps, lower peel strengths may be acceptable; whereas with smaller attachment overlaps, higher peel strengths may be necessary.

In one embodiment, the adhesive is disposed on at least one major surface of a substrate. In one embodiment, the adhesive is a continuous layer across the first major surface of the substrate, wherein the adhesive covers at least 20, 40, 50, 70, 80, 90, 99, or even 100% of one major surface of the substrate. The adhesive is applied at a thickness sufficient to adhere the adhesive article to a building's structural elements. The thickness of the adhesive typically ranges from about 2 mil (50 micrometers) to about 30 mil (762 micrometers). A thick layer of adhesive material may be desirable for some applications, for example so that the adhesive material conforms to an irregular surface of the structural element (e.g., concrete). Preferably, the adhesive forms a layer with sufficient adhesion between the adhesive article and the structural element. The time required for the adhesion to develop may vary due to humidity and/or ambient temperature.

The substrate of the adhesive article may be selected from a polymeric film, a paper, a nonwoven matrix, a woven matrix, a metallic sheet, a foam, and combinations thereof. Exemplary substrates include polyolefins such as polyethylene, polypropylene (including isotactic polypropylene), polystyrene, polyester (such as poly(ethylene terephthalate) and poly(butylene terephthalate)), polyvinyl alcohol, poly (caprolactam), poly(vinylidene fluoride), polylactides, cellulose acetate, ethyl cellulose, and the like. Commercially available backing materials useful include Kraft paper (available from Monadnock Paper, Inc.); cellophane (available from Flexel Corp.); spun-bond poly(ethylene) and poly(propylene), available under the trade designation "TYVEK" and "TYPAR" (available from DuPont, Inc.); and porous films obtained from poly(ethylene) and poly(propylene), available under the trade designation "TESLIN" (available from PPG Industries, Inc.), and "CELLGUARD" (available from Hoechst-Celanese).

The substrate can be selected based on the application. The substrate should be stable (i.e., does not auto-ignite or distort) at temperatures of at least 80° C., 85° C., 90° C., 93° C., 95° C., 98° C., 100° C., 150° C., 180° C., or even 200° C. In one embodiment, the substrate has some flexibility allowing the adhesive article to absorb some of the movement between the two structural elements and/or the pressure experienced from a fire hose. In one embodiment, a polyolefin substrate is selected due to its resistance to humidity changes, as opposed to a paper backing, which may be preferred from a lifetime durability standpoint.

The adhesive article of the present disclosure is non-porous. The Gurley second or Gurley unit is a unit describing the number of seconds required for 100 cubic centimeters (1 deciliter) of air to pass through 1.0 square inch of a given material at a pressure differential of 4.88 inches of water. The lower the Gurley second, the more porous the material. In one embodiment, the adhesive article has a Gurley value of greater than 5, 10, 20, 40, or even 60 Gurley seconds. It is believed that the non-porosity of the adhesive article is important for sealing of the joint assembly, preventing air and gas passage.

In one embodiment, the adhesive article can be used in a roll format (as shown in FIG. 4) sheet, or a die cut shape. In one embodiment, the adhesive article comprises a liner, which is removed from the adhesive side of the adhesive article prior to application to the structural elements.

In the present disclosure, after filling space 12 with the packing material, adhesive article 19 is placed over the space, flush with structural elements 11 and 13, forming the joint system. In one embodiment, the adhesive of the adhesive article contacts the packing material.

The adhesive article should sufficiently overlap the structural elements to maintain contact with the structural elements and maintain a seal over the lifetime of the joint. In one embodiment, the adhesive article overlaps the opening by at least 0.25, 0.5, 0.75, 1, 2, or even 4 inches (6.4, 12.7, 19, 25.4, 50.8, or even 101.6 mm) on either side; and at most 6 or even 12 inches (152.4, or even 304.8 mm). In other words, the adhesive article contacts the first attachment area by at least 0.25 inches and the second attachment area by at least 0.25 inches. The acceptable overlap of the adhesive article with the attachment areas can depend on the nature of the structural element (e.g., concrete versus gypsum); adhesive used (e.g., the 90 degree peel strength as mentioned above); and/or the flexibility of the substrate (e.g., more overlap needed for substrates that are not as flexible), as can be seen in the Example Section below.

Heretofore the means for sealing such joints has been to insert an insulation batting or to spray foam, putty, or caulk into the joint gap. Using an adhesive article as disclosed herein for a fire-resistant joint system has advantages over the putties, caulks and spray coatings, including the ability to use over a broader working range (for example, at temperatures below 4° C. and in wet conditions) with little preparation of the structural elements, and ease of use (i.e., rolling a strip of tape down a wall wherein the adhesive is contained up the adhesive substrate).

As shown in FIG. 1, the adhesive article of the present disclosure is fixedly attached to the first and second structural elements, such that the adhesive article is flush against the structural elements' surface in a wall-to-wall or floor-to-floor joint. Shown in FIG. 3, is an exemplary embodiment of the joint system of the present disclosure in a joint formed by two structural elements approximately at 90 degrees from one another, such as in wall-to-floor or head-of-wall joint. First structural element 31A is approximately at 90 degrees from second structural element 31B, forming space 32. Packing material 34 fills space 34 and adhesive article 39 is fixedly attached to both structural elements forming joint system 30.

As seen in both FIGS. 1 and 3, the adhesive article is attached to the outer surface of the wall (or floor) and the adhesive article maintains a distance from the outer surface of the wall which is nominally the thickness of the tape. Typical thickness of the adhesive articles of the present disclosure have a thickness of 50 micrometers to about 1 millimeter. Advantageously, if the joints disclosed herein occur on a visible wall, the feathering of the joint can be minimized due to the thinness of the adhesive article as compared to other systems of providing fire-resistance to joints.

Figure 2:
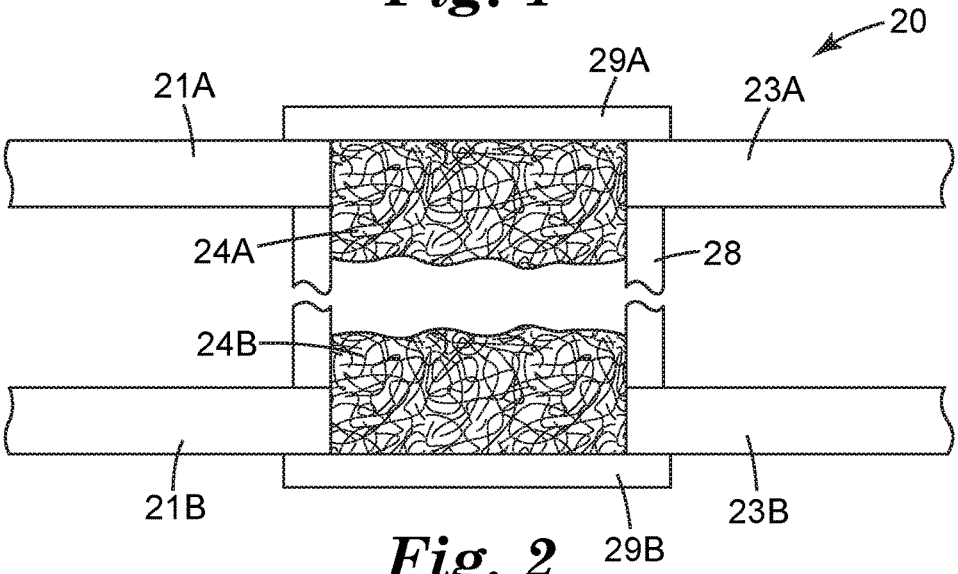

The joint system of the present disclosure is rated for protection of the "cold side" of the structure (e.g., wall or floor). In other words, the side of the wall away from the fire. Since, one cannot predict which side of the wall a fire will occur, in practical use, a fire-resistant joint system is used on both openings of the wall. Shown in FIG. 2 is one embodiment of the present disclosure, depicting a gypsum wall comprising two opposing sides, with studs 28 supporting structural elements 23A and 23B. The first side of the wall comprises structural elements 21A and 23A and packing material 24A, wherein adhesive article 29A is used to seal the opening on Side A and adhesive article 29B are used to seal the opening of Side B formed by structural elements 21B and 21B and comprising packing material 24B. For example, during a fire on Side A, adhesive article 29A may burn or melt in the fire. Although not wanting to be limited by theory, it is believed that packing material 24A and 24B act as a thermal barrier helping to minimize the temperatures experienced by adhesive article 29B on the cold side of the wall. It is also believed that adhesive article 29B acts as a non-porous barrier minimizing a stack effect (i.e., movement of air resulting from pressure, temperature, and/or moisture differences). These stack effects can lead to potential spreading of combustion products (e.g., flame, and/or hot gases including smoke, and heat) from one area to another throughout the building.

It has been discovered that packing the opening with a packing material and sealing with a non-porous adhesive article, such as a tape, provides a fire-resistant system or even a fire-rated joint system, fire-rated for 30 minutes, 1 hour, 2 hours, or even 4 hours. This is surprising because as mentioned above, the fire-rated joint system must meet the fire test and water hose test as disclosed in ASTM E1966 and/or UL 2079. The fire-rated system must also have the ability to flex with building movement and have long term durability (e.g., 20 years, 30 years or even 40 years). Furthermore, construction sites are typically thought of as dirty, with dust, dirt, etc. In one embodiment, the adhesive articles disclosed herein can be applied to the first and second structural elements without clean-up or priming of the structural elements. Still further, in one embodiment, the adhesive articles disclosed herein can be applied to water saturated structural elements such as cement concrete and still fixedly attach to the structural element.

Examples which are useful for understanding the present disclosure include the following.

Embodiment 1

Use of a non-porous adhesive article and a packing material to provide a fire-resistant joint system, wherein the fire-resistant joint system comprises a first structural element having a first attachment area and a second structural element having a second attachment area, the first and second structural elements being moveable with respect to one another, the first and second attachment areas defining a space therebetween, the space having a fixed length and a width which varies from a minimum width to a maximum width as the structural elements move with respect to each other, wherein the space comprises the packing material and the non-porous adhesive article is fixedly attached to the first attachment area and the second attachment area.

Embodiment 2

The use as in embodiment 1, wherein the non-porous adhesive article comprises a layer of adhesive selected from at least one of an epoxy, an acrylic, a urethane, a silicone, and a rubber.

Embodiment 3

The use as in of any one of the previous embodiments, wherein the adhesive is a pressure sensitive adhesive.

Embodiment 4

The use as in of any one of the previous embodiments, wherein the adhesive comprises at least one of (i) an acrylic adhesive and (ii) a styrene block copolymer and a tackifier.

Embodiment 5

The use as in any one of the previous embodiments, wherein the substrate is selected from at least one of a polymeric film, a paper, a nonwoven matrix, a woven matrix, a metallic sheet, and a foam.

Embodiment 6

The use as in any one of the previous embodiments, wherein the packing material is selected from at least one of mineral wool, ceramic fiber, glass fiber, and rockwool.

Embodiment 7

The use as in any one of the previous embodiments, wherein the space has a nominal width of at least 6.4 mm.

Embodiment 8

The use as in any one of the previous embodiments, wherein the space has a nominal width of at least 50.8 mm.

Embodiment 9

The use as in any one of the previous embodiments, wherein the first structural element is selected from at least one of cement, gypsum, wood, metal, and plastic.

Embodiment 10

The use as in any one of the previous embodiments, wherein the second structural element is selected from at least one of cement, gypsum, wood, metal, and plastic.

Embodiment 11

A fire-resistant joint system comprising (a) a non-porous adhesive article comprising a substrate and an adhesive disposed on a first major surface of the substrate;

(b) a packing material; and (c) a structure having a joint, the joint including a first structural element having a first attachment area and a second structural element having a second attachment area, the first and second structural elements being moveable with respect to one another, the first and second attachment areas defining a space therebetween, the space having a fixed length and a width which varies from a minimum width to a maximum width as the structural elements move with respect to each other, wherein the space comprises the packing material and wherein the adhesive is fixedly attached to the first attachment area and the second attachment area.

Embodiment 12

The fire-resistant joint system of embodiment 11, wherein the non-porous adhesive article comprises a continuous layer of adhesive selected from at least one of an epoxy, an acrylic, a urethane, a silicone, and a rubber.

Embodiment 13

The fire-resistant joint system of any one of embodiments 11-12, wherein the adhesive is a pressure sensitive adhesive.

Embodiment 14

The fire-resistant joint system of any one of embodiments 11-13, wherein the adhesive comprises at least one of (i) an acrylic adhesive and (ii) a styrene block copolymer and a tackifier.

Embodiment 15

The fire-resistant joint system of any one of embodiments 11-14, wherein the substrate is selected from at least one of a polymeric film, a paper, a nonwoven matrix, a woven matrix, a metallic sheet, and a foam.

Embodiment 16

The fire-resistant joint system of any one of embodiments 11-15, wherein the packing material is selected from at least one of mineral wool, ceramic fiber, glass fiber, and rockwool.

Embodiment 17

The fire-resistant joint system of any one of embodiments 11-16, wherein the first structural element is selected from at least one of cement, gypsum, wood, metal, and plastic.

Embodiment 18

The fire-resistant joint system of any one of embodiments 11-17, wherein the second structural element is selected from at least one of cement, gypsum, wood, metal, and plastic.

Embodiment 19

The fire-resistant joint system of any one of embodiments 11-18, wherein the fire-rated system passes Fire Test 2.

Embodiment 20

The fire-resistant joint system of any one of embodiments 11-18, wherein the fire-rated joint system passes the Fire Test 4.

Embodiment 21

The fire-resistant joint system of any one of embodiments 11-18, wherein the fire-rated joint system passes at least one of ASTM E-1966-07 and UL 2079.

Embodiment 22

A method of attaching a fire resistant joint system to a dynamic joint in a structure, the dynamic joint including a first structural element having a first attachment area and a second structural element having a second attachment area, the first and second structural elements being moveable with respect to one another, the first and second attachment areas defining a space therebetween, the space having a fixed length and a width which varies from a minimum width to a maximum width as the structural elements move with respect to each other, the method for attaching comprising the step of:

(a) filling the space with a packing material; and (b) fixedly attaching a non-porous adhesive article comprising a substrate and an adhesive disposed on a first major surface of the substrate such that the adhesive contacts the first attachment area and the second attachment area to form a fire-resistant joint system.

EXAMPLES

Advantages and embodiments of this disclosure are further illustrated by the following examples, but the particular materials and amounts thereof recited in these examples, as well as other conditions and details, should not be construed to unduly limit this invention. In these examples, all percentages, proportions and ratios are by weight unless otherwise indicated.

All materials are commercially available or known to those skilled in the art unless otherwise stated or apparent.

The following abbreviations are used: cm=centimeter; in =inch; lb=pound; mm=millimeter; m=meter; and ft=foot.

Test Methods

Gypsum Wall Construction

A wall was constructed as a 2 hour fire-rated construction joint consisting of gypsum board/steel stud assembly constructed of the materials and in the manner described in the individual U400-Series Wall or Partition Design in the UL Fire Resistance Directory (2014) and included the following construction features: Wall framing consisted of steel channel studs. Steel studs were a minimum 3⅝ in. (92 mm) wide by 1¼ in. (32 mm) deep with a minimum 25 gauge steel channels. Steel stud spacing was a maximum of 24 in. (610 mm) on center. Two layers ⅝ in. (16 mm) thick gypsum wallboard, as specified in the individual U400-Series Design were used on each side of the wall.

Various sized wall constructions were made, wherein each wall was a box comprising steel studs along the 4 minor sides with a front surface of gypsum board and a back surface of gypsum board. Two or three sections of walls were aligned next to one another with a linear opening (at time of installation of joint system) of about 2 in (5.1 cm), unless stated otherwise. The assembly was placed into an external metal frame and secured during testing.

Concrete Floor Construction

A floor was constructed as a 2 hour fire-rated construction joint with a minimum 4½ in. (114.3 mm) thick steel-reinforced lightweight structural concrete. Two sections of the concrete slabs that were 16 in (40.6 cm) by 35 in (88.9 cm) were aligned next to one another with a linear opening (at time of installation of joint system) of about 2 in (5.1 cm), unless stated otherwise. The assembly was placed into an external metal frame and secured during testing.

Fire Test 1

In Fire Test 1, the constructions were tested according to Underwriters Laboratory Inc., Standard for Safety UL 2079 "Test for Fire Resistance of Building Joint Systems", fourth edition dated Dec. 12, 2012 for a 2-hour fire-rating.

Briefly, the linear opening was cycled 25% (5.08 cm joint expanded to 6.35 cm and compressed to 3.81 cm) for 500 cycles at 10 cycles/minute. At the conclusion of the cycling, the opening was held at the extended state, 6.35 cm, for the remainder of the test. One side of the wall was exposed to fire at temperatures following UL 2079 for 2 hours while the joint was in the 25% extended state. Thermocouples were placed at two locations on the joint, approximately ⅓ and ⅔ up the length of the joint, centered on the middle of the joint on the cold side of the wall to monitor the temperature. The Hose Stream evaluation was done on a separate, but similarly constructed wall construction that was cycled 25% and exposed to fire for one hour as described in UL 2079.

There are four primary results associated with the testing procedure as outlined in UL 2079: Flexibility, Flame, Temperature, and Hose Stream.

Flexibility—The two separate structural elements of the system are extended and compressed by a stated amount. At the completion of this extension and compression testing, the installation (e.g., adhesive article and packing material) must show no tears or loss of adhesion to the construction assembly in order to pass. If any tears or loss of adhesion to the structural elements are noted, this section of the testing fails.

Flame—The system is exposed to elevated temperatures (e.g., a controlled fire). The installation must show no tears or loss of adhesion (in other words, maintain integrity) to the construction assembly in order to pass. If any tears or loss of adhesion to the structural elements are noted, this section of the testing fails.

Temperature—While the system is exposed to elevated temperatures, the installation is not allowed to have the temperature on the cold side of the wall exceed 181° C. above ambient. For example, if ambient temperature is 23° C. and the temperature on the cold side of the wall exceeds 204° C., this section of the testing fails.

Hose Stream—The system is first exposed to elevated temperatures. Then, the system is exposed to water dispensed through a high pressure fire hose. The installation must show no tears or loss of adhesion to the construction assembly in order to pass. If any tears or loss of adhesion to the structural elements allow water to penetrate the opening, this section of the testing fails.

Fire Test 2

Fire Test 2 was similar to Fire Test 1, except that only the Flame and Temperature results were evaluated with the following modifications to Fire Test 1: There was no cycling of the linear opening and during the rest of the testing, the opening was tested at its nominal (not extended) state. There was no hose stream testing performed. Thermocouples were placed at two locations per substrate sample—approximately at ⅓ and ⅔ of the length of each substrate material, centered on the middle of the joint on the cold side of the wall (the opposite side of the fire).

Fire Test 3

Fire Test 3 was similar to Fire Test 1, except that only the Hose Stream results were evaluated with the following modifications to Fire Test 1: There was no cycling of the linear opening and during the rest of the testing the opening was tested at its nominal (not extended) state. No thermocouples were used to measure temperature at the joint during testing.

Fire Test 4

Fire Test 4 was similar to Fire Test 1, except that only the Flame, Temperature, and Hose Stream results were evaluated with the following modifications to Fire Test 1: There was no cycling of the linear opening and during the rest of the testing, the opening was tested at its nominal (not extended) state. Thermocouples were placed at two locations per substrate sample—approximately at ⅓ and ⅔ of the length of each substrate material, centered on the middle of the joint on the cold side of the wall (the opposite side of the fire). The Hose Stream evaluation was done at the conclusion of the fire test on the same assembly.

Porosity Test

The porosity was measured using a Model 4110 Genuine Gurley Densometer, Gurley Precision Instruments, Troy, N.Y. Samples were clamped within the densometer's one square inch port, and the Gurley values were measured following ISO 5636-5:2003 "Paper and board—Determination of air permeance (medium range)—Part 5: Gurley method".

Peel Adhesion Test

The 90 degree angle peel adhesion test was performed generally as described in ASTM D6252/6252M-98 (2011) "Standard Test Method for Peel Adhesion of Pressure-Sensitive Label Stocks at a 90° Angle". The adhesive articles were cut into 1 in (2.54 cm) wide strips. The construction assembly materials (concrete or gypsum wallboard) were wiped clean with only a cloth, and the strips were adhered by hand to the stated construction assembly material with a rubber roller using hand pressure. A dwell time of between 5 sec and 60 sec was employed, and the sample was measured for 90 degree angle peel adhesion at a speed of 12 in/min. The testing was done at 23° C. and 50% relative humidity. Results are reported in lbs/in.

Materials Table

| Material | Description |
|---|---|
| Tape 398 FR | A flame retardant tape comprising a glass cloth backing with a pressure sensitive acrylic adhesive available under the trade designation "3M GLASS CLOTH TAPE 398 FR" from 3M Co., St. Paul, MN |
| Tape 8067 | An acrylic pressure sensitive adhesive tape available under the trade designation "3M ALL-WEATHER FLASHING TAPE 8067" from 3M Co., with a tape thickness of (0.0099 in) 0.25 mm with a backing thickness of (0.005 in) 0.13 mm. |
| Vinyl Tape | A tape available under the trade designation "3M 471 YELLOW VINYL TAPE" from 3M Co. |
| Al Foil | A tape available under the trade designation "3M 425 DWB ALUMINUM FOIL TAPE" from 3M Co. |
| Duct Tape | A tape available under the trade designation "3M 3939 HEAVY DUTY DUCT TAPE" from 3M Co. |
| PTFE Tape | A tape available under the trade designation "3M PTFE FILM TAPE 5490" from 3M Co. |
| Polyimide Tape | A tape available under the trade designation "3M 5413 POLYIMIDE FILM TAPE" from 3M Co. |
| Film 2024 | A sheet good available under the trade designation "STYLE 2024 REEMAY SPUNBONDED POLYESTER NONWOVENS" from Kavon Filter Products Co., Farmingdale, NJ |
| Tyvek | A film available under the trade designation "DUPONT TYVEK HOMEWRAP" from DuPont, Wilmington, DE |
| ZIP Tape | A tape available under the trade designation "ZIP System tape" from J. M. Huber Corp., Edison, NJ |
| CW Tape | A tape available under the trade designation "VENTURE TAPE 1525CW-3" from Venture Tape, Rockland, MA |

-continued

| Materials Table | |
|---|---|
| Material | Description |
| Tape 1100 | A tape available under the trade designation "3M TEMFLEX CORROSION PROTECTION TAPE 1100" from 3M Co. |
| Masking Tape | A tape available under the trade designation "3M 232 MASKING TAPE" from 3M Co. |
| Tape 06147 | A tape available under the trade designation "SCOTCH ELCTRICAL MOISTURE SEALANT ROLL 06147" from 3M Co. |
| Tape 3750 | A tape available under the trade designation "3M SCOTH COMMERCIAL GRADE SHIPPING PACKAGING TAPE 3750" from 3M Co. |

Examples

Comparative Example 1: Fire Retardant Substrate

Walls were made following the Gypsum Wall Construction above. A wall assembly was constructed with two walls (16 in (406 mm) by 35 in (889 mm)) having a 2 inch (51 mm) width by 35 in (889 mm) linear opening therebetween. A flame retardant tape, Tape 398 FR, was placed over the entire length of the linear opening on both sides of the wall assembly, overlapping the gypsum wallboard by a minimum of 3.81 cm (1.5 in.) on each side of the opening.

The system was tested following Fire Test 4. The system failed the Flame, Temperature, and Hose Stream tests.

Example 1: Fire Resistive Joint System

Walls were made following the Gypsum Wall Construction above. A wall assembly was constructed with a 34 in (864 mm) by 84 in (2134 mm) wall and a 32 in (813 mm) by 84 in (2134 mm) wall having a 2 in (25 mm) width by 84 in (2134 mm) length linear opening therebetween. A 4 in (10.2 cm) wide piece of mineral wool (Roxul Inc., Ontario, Canada) was compressed to fit into the linear opening of the wall. The mineral wool was installed at full depth of the assembly at 15.24 cm (6 in). Tape 8067 with liner removed, was placed over and in contact with the mineral wool, overlapping the gypsum wallboard by 1 in (2.5 cm) on each side of the opening and down the entire length of the opening. The Tape 8067 was placed on both sides (cold side and the hot (or fire side)) of the wall assembly. The joint system was tested following Fire Test 1 for Flexibility, Flame, Temperature, and Hose Stream and passed each of these tests.

Example 2: Fire Resistive Joint System

Floors were made following the Concrete Floor Construction described above. A floor assembly was constructed with two floors (16 in (406 mm) by 35 in (889 mm)) having a 2 in (51 mm) width by 35 in (889 mm) length linear opening therebetween. A 10.2 cm (4 in.) wide piece of mineral wool (Roxul Inc.) was compressed to fit into the linear opening of the floor. The mineral wool was installed at full depth of the assembly at 11.4 cm (4.5 in.). Tape 8067 was placed over and in contact with the mineral wool, overlapping the concrete by 2.5 cm (1 in.) on each side of the opening and down the entire length of the opening. Tape 8067 was placed only on the cold side of the floor (the side that was to be away from the fire). The joint system was tested following Fire Test 4 for Flame, Temperature, and Hose Stream and passed each of these tests.

Substrate Screen A

Walls were made following the Gypsum Wall Construction above. A wall assembly was constructed with three walls in the following order A: 10 in (254 mm) by 84 inch (213 mm); B: 24 inch (610 mm) by 84 inch (213 mm); and C: 32 inch (813 mm) by 84 inch (213 mm) having an average 1.63 inch (41 mm) width by 84 inch (2134 mm) length opening between walls A and B and between walls B and C. A 7.62 cm (3 in.) wide piece of mineral wool (Roxul Inc.) was compressed to fit into both linear openings. The mineral wool was installed full depth of the wall assembly at 15.24 cm (6 in.).

Instead of running a single piece of tape down the entire length of the opening as done above, various materials were tested along the length of the opening for substrate screening. The various substrate materials (shown in Table 1 below), liners removed if present, were placed along the length of the each opening (either 2 or 3 substrates used to cover 1 linear opening) covering the length of the opening on the cold side of the wall. Tape 8067 was used to hold the substrate material in place on the wall assembly. Tape 8067 was used to frame each of the substrate materials, overlapping the substrate materials by a minimum of 0.64 cm (0.25 in) as they were held to the gypsum wall. Tape 8067 did not (or minimally) overlapped the linear opening along its length. Where the different substrate materials met on the linear joint, they were covered with a strip of Tape 8067 in order to maintain a seal. Substrates were placed only on the cold side of the floor (side away from the fire). The joint system was then tested following Fire Test 2.

The substrates tested and the results from Fire Test 2 are described in the Table 1 below.

TABLE 1

| Sample | Material | Substrate | Thickness of the substrate (mm)* | Fire Test 2 Flame | Fire Test 2 Temperature |
|---|---|---|---|---|---|
| 1 | Vinyl Tape | Vinyl | 0.1 | fail | fail |
| 2 | Tape 06147 | Vinyl | 0.2 | pass | pass |
| 3 | Tape 3750 | Polypropylene | 0.05 | fail | pass |
| 4 | Al Foil | Dead-soft aluminum | 0.07 | pass | pass |
| 5 | Duct Tape | polyethylene laminated to cloth reinforcement | 0.2 | pass | pass |
| 6 | PTFE Tape | polytetra-fluoroethylene | 0.05 | pass | pass |
| 7 | Polyimide Tape | polyimide | 0.07 | pass | pass |

*Data taken from published technical data sheets

Substrate Screen B

A wall assembly was constructed as described in Substrate Screen A above. A 7.62 cm (3 in.) wide piece of mineral wool (Roxul Inc.) was compressed to fit into both linear openings (2 inch width by 84 inch length each). The mineral wool was installed full depth of the wall assembly at 15.24 cm (6 in).

Instead of running a single piece of tape down the entire length of the opening, various materials were tested along the length of the opening for substrate screening. The various substrate materials (shown in table 1 below), liners removed if present, were placed along the length of the each opening (either 2 or 3 substrates used to cover 1 linear opening) covering the length of the opening on the cold side of the wall. Tape 8067 was used to hold the substrate material in place on the wall assembly. Tape 8067 was used to frame each of the substrate materials, overlapping the substrate materials by a minimum of 0.64 cm (0.25 in) as they were held to the gypsum wall. Tape 8067 did not (or minimally) overlapped the linear opening along its length. Where the different substrate materials met on the linear joint, they were covered with a strip of Tape 8067 in order to maintain a seal. The joint system was then tested following Fire Test 2. The results are shown in Table 2 below.

The various substrate materials were tested following the Porosity Test described above. The results are also shown in Table 2 below.

TABLE 2

| Sample | Material | Substrate | Fire Test 2 Fire | Fire Test 2 Temperature | Porosity Gurley sec |
|---|---|---|---|---|---|
| 1 | Film 2024 | Spunbound polyester nonwoven | Fail | Fail | <1 |
| 2 | Tyvek | Spunbound olefin nonwoven | Fail | Fail | 5 |
| 3 | PTFE | Extruded polytetra-fluoroethylene | Pass | Pass | >60 |
| 4 | Polyimide | Polyimide | Pass | Pass | >60 |

As shown in Table 2, if the porosity of the adhesive article is 5 Gurley seconds or less, the sample failed the fire and temperature testing for the 2-hour rating.

Adhesion Screening A

A wall assembly was constructed as described in Substrate Screen A above. A 7.62 cm (3 in.) wide piece of mineral wool (Roxul Inc.) was compressed to fit into both linear openings (2 inch (51 mm) width by 84 (2134 mm) inch length each). The mineral wool was installed full depth of the wall assembly at 15.24 cm (6 in). Instead of running a single piece of tape down the entire length of the opening as done above, various tapes were tested along the length of the opening for adhesion screening. The various substrate materials (shown in Table 3 below), liners removed if present, were placed along the length of the each opening (up to 9 substrates were used to cover 1 linear opening) covering the length of the opening on the cold side of the wall only. Not only was the adhesive varied, but the amount of overlap of the sample has on each side of the linear opening was varied. Fire Test 3 was initiated within 10 minutes or less of the PSA samples being applied to the gypsum wall assemblies. The results are shown in Table 3.

Adhesion Screening B

A floor assembly was constructed as described in Example 2 above. A 10.2 cm (4 in.) wide piece of mineral wool (Roxul Inc.) was compressed to fit into the linear opening (2 inch (51 mm) width by 35 inch (889 mm) length each). The mineral wool was installed full depth of the floor assembly at 114 mm (4.5 in.). The various substrate materials (shown in Table 3 below), liners removed if present, were placed along the length of the each opening (3 substrates used to cover 1 linear opening) covering the length of the opening on the cold side of the floor only. Not only was the adhesive varied, but the amount of overlap of the sample has on each side of the linear opening was varied. Fire Test 3 was initiated within 10 minutes or less of the PSA samples being applied to the concrete floor assemblies. The results are shown in Table 3.

Separately, the various PSA tapes were also tested for adhesion on concrete and/or gypsum wallboard following the Peel Adhesion Test described above. These results are also shown in Table 3 below.

TABLE 3

| Sample | Material | Adhesive Type | Structural Element | Peel Adhesive (lbs/in) | Fire Test 3 Overlap inches (mm) | Fire Test 3 Hose Stream |
|---|---|---|---|---|---|---|
| 1 | Tape 8067 | Acrylic | Concrete | 3.2 | 1 (25 mm) | Pass |
| 2 | ZIP Tape | Acrylic | Concrete | 2 | 1 (25 mm) | Pass |
| 3 | Duct Tape | Rubber | Concrete | 0.7 | 2 (51 mm) | Fail |
| 4 | Al Foil | Acrylic | Concrete | 0.4 | 1 (25 mm) | Fail |
| 5 | CW Tape | Acrylic | Concrete | 0.4 | 1 (25 mm) | Fail |
| 6 | Polyimide Tape | Silicone | Concrete | 0.3 | 2 (51 mm) | Fail |
| 7 | PTFE Tape | Silicone | Concrete | 0.3 | 1 (25 mm) | Fail |
| 8 | TAPE 1100 | Rubber | Concrete | 0.1 | 1 (25 mm) | Fail |
| 9 | Tape 8067 | Acrylic | Gypsum | >2* | 2 (51 mm) | Pass |
| 10 | Tape 8067 | Acrylic | Gypsum | >2* | 0.5 (13 mm) | Pass |
| 11 | Al Foil | Acrylic | Gypsum | 1.1 | 4 (102 mm) | Pass |
| 12 | Al Foil | Acrylic | Gypsum | 1.1 | 2 (51 mm) | Fail |
| 13 | ZIP Tape | Acrylic | Gypsum | 1.9 | 1 (25 mm) | Pass |
| 14 | ZIP Tape | Acrylic | Gypsum | 1.9 | 0.5 (13 mm) | Fail |
| 15 | CW Tape | Acrylic | Gypsum | 0.8 | 2 (51 mm) | Pass |
| 16 | CW Tape | Acrylic | Gypsum | 0.8 | 1 (25 mm) | Pass |
| 17 | Duct Tape | Rubber | Gypsum | 0.7 | 2 (51 mm) | Fail |
| 18 | Duct Tape | Rubber | Gypsum | 0.7 | 1 (25 mm) | Fail |
| 19 | Masking Tape | Rubber | Gypsum | 0.5 | 2 (51 mm) | Fail |
| 20 | PTFE Tape | Silicone | Gypsum | 0.4 | 2 (51 mm) | Fail |
| 21 | Polyimide Tape | Silicone | Gypsum | 0.3 | 2 (51 mm) | Fail |
| 22 | 3750 Tape | Rubber | Gypsum | 0.3 | 2 (51 mm) | Fail |

*during removal, the paper from the surface of the gypsum wallboard tore before the tape could be removed Water Saturated Surface Screening Initial Peel: Tape 8067 was applied to a sample of concrete. After 5 minutes of contact, Tape 8067 was removed by hand.

Wet Peel: Approximately 10 milliliters of water was applied to the surface of a sample of concrete. Within less than 1 minute, a piece of Tape 8067 was applied onto the wet concrete. After 5 minutes of contact, Tape 8067 was removed by hand.

There was little to no difference noted when removing the Tape 8067 between the Initial and Wet Peels.

Foreseeable modifications and alterations of this invention will be apparent to those skilled in the art without departing from the scope and spirit of this invention. This invention should not be restricted to the embodiments that are set forth in this application for illustrative purposes.

What is claimed is:

1. A method of using a non-porous adhesive article and a packing material to provide a fire-resistant joint system, the method comprising:

fixedly attaching the non-porous adhesive article to a first attachment area and a second attachment area, wherein the non-porous adhesive article includes an adhesive layer disposed on at least one major surface of a substrate, wherein the non-porous adhesive article has a Gurley value of greater than 10 Gurley seconds, wherein the fire-resistant joint system comprises a first structural element having the first attachment area and a second structural element having the second attachment area, the first and second structural elements being moveable with respect to one another, the first and second attachment areas defining a space therebetween, the space having a fixed length and a width which varies from a minimum width to a maximum width as the structural elements move with respect to each other, wherein the space comprises the packing material and wherein the adhesive layer disposed on the at least one major surface of the substrate contacts the first attachment area, and the second attachment area, and wherein the fire-resistant joint system is configured such that the packing material is positioned between a fire and the non-porous adhesive article.

2. The method of claim 1, wherein the adhesive in the adhesive layer is selected from at least one of an epoxy, an acrylic, a urethane, a silicone, and a rubber.

3. The method of claim 1, wherein the adhesive layer is a pressure sensitive adhesive layer.

4. The method of claim 1, wherein an adhesive in the adhesive layer comprises at least one of (i) an acrylic adhesive and (ii) a styrene block copolymer and a tackifier.

5. The method of claim 1, wherein the substrate is selected from at least one of a polymeric film, a paper, a nonwoven matrix, a woven matrix, a metallic sheet, and a foam.

6. The method of claim 1, wherein the space has a nominal width of at least 6.4 mm.

7. The method of claim 1, wherein the space has a nominal width of at least 50.8 mm.

8. The method of claim 1, wherein the first structural element is selected from at least one of cement, gypsum, wood, and metal.

9. The method of claim 8, wherein the second structural element is selected from at least one of cement, gypsum, wood, metal, and plastic.

10. The method of claim 1, wherein the adhesive article maintains a distance from the outer surface of the first attachment area which is nominally the thickness of the adhesive article.

11. The method of claim 1, wherein the substrate is stable at temperatures of at least 80° C.

12. The method of claim 1, wherein the width of the space is parallel to the first attachment area.

13. The method of claim 1, wherein the adhesive layer covers at least 40% of at least one major surface of the substrate.

14. The method of claim 1, wherein, the adhesive layer covers at least 80% of at least one major surface of the substrate.

15. The method of claim 1, wherein the packing material is selected from at least one of mineral wool, ceramic fiber, glass fiber, and rockwool.

16. The method of claim 1, wherein the adhesive layer disposed on the first major surface of the substrate contacts the first attachment area, the second attachment area, and the packing material.

17. A fire-resistant joint system comprising (a) a non-porous adhesive article comprising a substrate and an adhesive layer disposed on a first major surface of the substrate, wherein the non-porous adhesive article has a Gurley value of greater than 10 Gurley seconds;

(b) a packing material; and (c) a structure having a joint, the joint including a first structural element having a first attachment area and a second structural element having a second attachment area, the first and second structural elements being moveable with respect to one another, the first and second attachment areas defining a space therebetween, the space having a fixed length and a width which varies from a minimum width to a maximum width as the structural elements move with respect to each other, wherein the space comprises the packing material and wherein the adhesive article is fixedly attached via the adhesive layer to the first attachment area, and the second attachment area, and wherein the fire-resistant joint system is configured such that the packing material is positioned between a fire and the non-porous adhesive article.

18. The fire-resistant joint system of claim 17, wherein the fire-rated joint system passes for at least 30 minutes at least one of ASTM E-1966-07 and UL 2079.

19. A method of attaching a fire resistant joint system to a dynamic joint in a structure, the dynamic joint including a first structural element having a first attachment area and a second structural element having a second attachment area, the first and second structural elements being moveable with respect to one another, the first and second attachment areas defining a space therebetween, the space having a fixed length and a width which varies from a minimum width to a maximum width as the structural elements move with respect to each other, the method for attaching comprising the step of:

(a) filling the space with a packing material; and (b) fixedly attaching a non-porous adhesive article comprising a substrate and an adhesive disposed on a first major surface of the substrate, and having a Gurley value of greater than 10 Gurley seconds, such that the adhesive disposed on the first major surface of the substrate contacts the first attachment area, and the second attachment area, to form a fire-resistant joint system, wherein the fire-resistant joint system is configured such that the packing material is positioned between a fire and the non-porous adhesive article.

20. The method of claim 19, wherein the non-porous adhesive article is in a roll format.

* * * * *